US008528240B2

(12) United States Patent
Ong et al.

(10) Patent No.: US 8,528,240 B2
(45) Date of Patent: Sep. 10, 2013

(54) STEAM IRON

(75) Inventors: Chee Keong Ong, Singapore (SG); Boon Khian Ching, Singapore (SG); Mohankumar Valiyambath Krishnan, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 96 days.

(21) Appl. No.: 13/143,574

(22) PCT Filed: Jan. 8, 2010

(86) PCT No.: PCT/IB2010/050057

§ 371 (c)(1),
(2), (4) Date: Jul. 7, 2011

(87) PCT Pub. No.: WO2010/086756

PCT Pub. Date: Aug. 5, 2010

(65) Prior Publication Data

US 2011/0271565 A1 Nov. 10, 2011

(30) Foreign Application Priority Data

Jan. 28, 2009 (EP) ..... 09151540

(51) Int. Cl.
*D06F 75/18* (2006.01)
*D06F 75/26* (2006.01)

(52) U.S. Cl.
USPC ..... 38/77.8; 38/77.9

(58) Field of Classification Search
USPC ..... 38/74–77.83, 90–92
See application file for complete search history.

(56) References Cited

U.S. PATENT DOCUMENTS

| | | | | |
|---|---|---|---|---|
| 1,365,186 | A * | 1/1921 | Oca Balda | 219/248 |
| 2,418,511 | A | 4/1947 | Hume | |
| 2,427,474 | A | 9/1947 | Purpura | |
| 2,664,653 | A | 1/1954 | Voskresenski | |
| 2,674,054 | A * | 4/1954 | Maykemper | 38/77.1 |
| 2,708,801 | A * | 5/1955 | Voskresenski | 38/77.83 |
| 2,741,044 | A * | 4/1956 | Maykemper | 38/77.5 |
| 3,224,122 | A * | 12/1965 | Jepson et al. | 38/77.2 |
| 3,986,282 | A * | 10/1976 | Nelson | 38/77.83 |
| 5,136,796 | A | 8/1992 | Farrington | |
| 6,935,056 | B2 | 8/2005 | Milanese | |
| 7,469,492 | B1 | 12/2008 | You | |

FOREIGN PATENT DOCUMENTS

| | | |
|---|---|---|
| EP | 0315915 A1 | 5/1989 |
| FR | 602293 | 3/1926 |

* cited by examiner

*Primary Examiner* — Ismael Izaguirre

(57) ABSTRACT

A steam iron having a bipartite steam rate control, based on a combination of a user-control, which allows a user to consciously set a desired steam rate, and an intuitively operated handle, which may conditionally provide the steam rate control assembly with corrective, energy saving input.

18 Claims, 4 Drawing Sheets

STEAM IRON

FIELD OF THE INVENTION

The invention relates to steam irons, and more in particular to the control of steaming functions of such irons.

BACKGROUND

A domestic steam iron has the capability to generate steam and to subsequently release this steam through outlet openings provided in the soleplate of the iron. The steam, which is applied directly to a garment being ironed, helps to diminish the ironing effort and to improve the ironing result.

Modern steam irons may come equipped with a steam rate control, for example in the form of a turnable knob or a slider provided on the iron housing. While a low steam rate setting may suffice for efficiently ironing moderately creased clothes (or patches thereof), a high steam rate setting may be selected to aid in the removal of tough wrinkles. The control allows the user at any time to select the steam rate setting that is appropriate for the (patch of) garment at hand. Practice shows, however, that some if not most users do not bother to adjust the steam rate once they have started an ironing session. Accordingly, when the maximum steam rate has been selected initially, the iron may remain set to produce larger amounts of steam than necessary for achieving a proper ironing result. Moreover, many users tend to park an iron horizontally between different ironing strokes, e.g. during garment changing or rearrangement, which results in continuation of maximum steam production during idle time.

In an attempt to put a curb on the energy wastage that is associated with such use of a steam iron, it has been suggested to fit the iron with an intuitively operated handle that controls the steam rate. See for an example of such an iron FR602293. The working of an intuitive handle may rely on the downward force that is exerted by a user's hand as he steers the iron across a garment. In general, a user will intuitively apply a larger downward force on the handle as the degree of wrinkling in a garment increases. The applied force may thus be taken as a measure of the desired steam rate. When no force is applied, for example when the iron is parked on an iron rest, the production and/or release of steam may be halted.

Although the intuitive handle seems to provide a solution to the problem of energy wastage due to unnecessary steam production, research has shown that the range of forces exerted on a handle by an ironing user varies per individual. This means, inter alia, that the minimum force that is applied during an ironing session is individual-dependent. In addition, individual users do not display consistent force-exertion behaviour across different ironing sessions either. As an intuitive handle has a minimum force threshold that must be exceeded in order to activate it, users of an iron with such a handle may not, or not at all times, automatically apply sufficient force on the handle to bring about the release of steam. Furthermore, even though the handle may thus work unsatisfactorily, it may not be possible to put the handle out of action or to override it, and to specify the desired steam rate in a different manner.

SUMMARY

It is an object of the present invention to provide for a steam iron that overcomes or mitigates one or more of the above-described problems.

To this end, a steam iron is provided that includes a handle, moveable between a first handle position and a second handle position, whereby a biasing mechanism is provided to bias the handle into the first handle position. The steam iron also includes a user-control, adjustable between a first state and a second state, and a steam rate control assembly, operatively connected to the handle and the user-control, and configured to set a steam rate of the steam iron. The steam rate control assembly is configured such that the steam rate is set based on the user-control, irrespective of the position of the handle, when the user-control is in the first state; and such that the steam rate is set based on at least a position of the handle when the user-control is in the second state.

A steam iron according to the present invention provides a bipartite steam rate control, based on the synergetic combination of the two controls discussed above: a user-control, which allows a user to consciously set a desired steam rate, and an intuitively operated handle, which may conditionally provide the steam rate control assembly with corrective, energy saving input. Advantageously, the user-control enables the user to put the intuitive handle out of action in case it does not function satisfactorily, e.g. when ironing only mildly creased clothes, or in case its operation is not required, e.g. when no steaming is desired at all. Depending on the desired functionality, the first state of the user-control may comprise two or more selectable user-control positions, each of which may be associated with its own steam rate. The more first-state user-control positions, the wider the choice available to the user to unambiguously select the desired steam rate, independent of the handle position.

In an advantageous embodiment, the steam rate control assembly is configured such that a steam rate that is set when the user-control is in its first state is smaller than a steam rate that is set when the user-control is in its second state.

That is to say, the first state of the user-control corresponds to one or more relatively low steam rates, while the second state of the user-control corresponds to one or more medium or high steam rates. Since the user-control is operated consciously, a user may determine whether he desires a low or a high steam rate. When a low steam rate is selected, the iron's energy consumption is moderate, and there is little need for corrective, energy saving input from the intuitive handle. Besides, the selection of a low steam rate indicates that only mildly creased garments are being ironed, such that the force that is intuitively exerted on the handle might easily be too small to activate it anyway. When the need for energy saving action arises, however, i.e. when a medium or high steam rate is selected, the steam rate control assembly will automatically involve input from the intuitive handle in setting the steam rate. As the conscious selection of a high steam rate indicates that more heavily wrinkled garments are being ironed, the force exerted on the intuitive handle will typically suffice to activate it.

The arrangement may be such that the user-control is primarily concerned with the selection a desired base steam rate. When the steam rate set by the user-control exceeds a certain threshold, whereby the user-control passes into its second state, the base steam rate may be fixed at the threshold value and the intuitive handle may be put in action to provide an extra dosage of steam in dependence of the force exerted thereon. Release of the handle will then ensure a return to the base steam rate to save energy.

These and other features and advantages of the invention will be more fully understood from the following detailed description of certain embodiments of the invention, taken together with the accompanying drawings, which are meant to illustrate and not to limit the invention.

DETAILED DESCRIPTION

Figure 1:
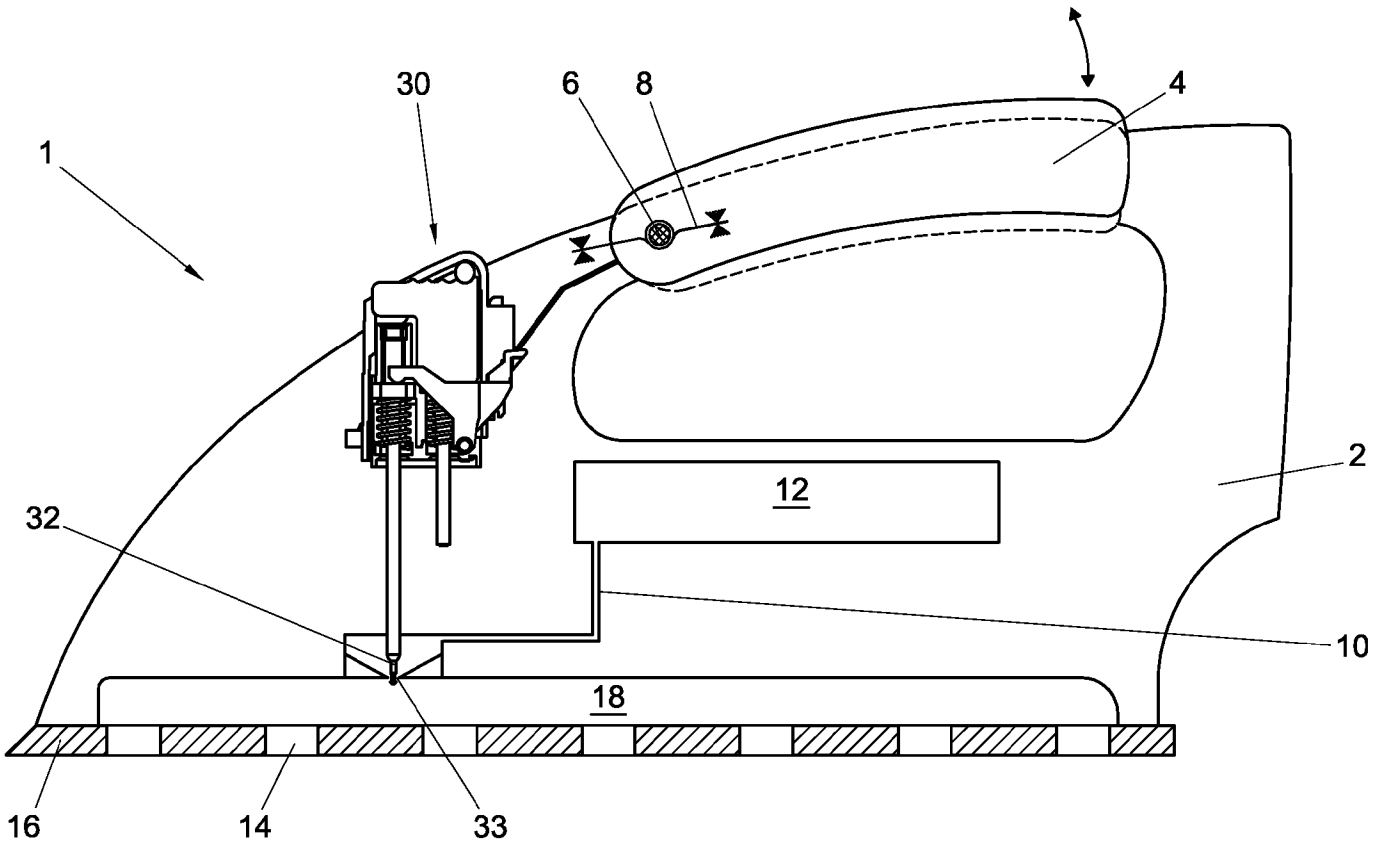
FIG. 1 is a schematic side view of an exemplary steam iron according to the present invention.

FIG. 1 schematically shows an exemplary embodiment of a steam iron 1 according to the present invention. It will be appreciated that several components of the iron which are well known and have no particular relevance to the present invention are omitted for reasons of clarity.

Steam iron 1 comprises a housing 2 that is fitted with an intuitively operated handle 4. Handle 4 is pivotable between a first, elevated position and a second, lower position around a hinge 6 that connects the handle 4 to the housing 2. In FIG. 1, the handle 4 is hinged near its front end, though in other embodiments it may be hinged at other points, such as its middle or its back end. Due to the action of a biasing mechanism 8, handle 4 resides in its first position when no external, downward force is applied thereto. The biasing mechanism may, for example, be integrated in hinge 6 in the form of a spring hinge, as shown in FIG. 1. Alternatively, it may be provided in a fulcrum 38 of a lever 34 (to be discussed hereafter) that is connected to the handle. Handle 4 is operably connected to a steam rate control assembly 30. The steam rate control assembly 30 includes a valve 32, that is disposed in a water channel 10 that leads from a refillable water reservoir 12 to outlet openings 14 in the heated soleplate 16. When valve 32 is in an open position, water is allowed to flow from reservoir 12, through valve 32, to a heated steam chamber 18. In steam chamber 18, the water is converted from its liquid form into steam, after which it is released through outlet openings 14 in soleplate 16. Naturally, when the valve 32 is in a closed position, no water flows from the water reservoir to steam chamber 18, and no steam is produced or released.

Although FIG. 1 depicts a steam iron 1 with an integrated water reservoir 12, i.e. a water reservoir integrated into the housing 2 that is purposefully moveable by the user during ironing, it is noted that in another embodiment of the steam iron the water reservoir may be arranged external to said housing 2 in a stationary body. This arrangement is common in so called system iron, which, as a rule, feature a relatively large water reservoir and a pressurized steam chamber upstream of the handle-operated valve 32. In contrast to the embodiment of FIG. 1, in which the valve 32 controls a flow of liquid water, the valve in these steam iron systems may control a flow of steam. This is a result of the fact that heating of the water in the former embodiment tends to be taken care of downstream of the valve 32, in steam chamber 18 near the soleplate 16 of the iron 1, while in the latter embodiment heating is provided for in the aforementioned external, pressurized steam chamber.

Attention is now invited to the construction and operation of the steam rate control assembly 30. The construction of the steam rate control assembly 30 will be described first with reference to FIG. 2. Subsequently its operation will be clarified with reference to FIGS. 3-6.

Figure 2:
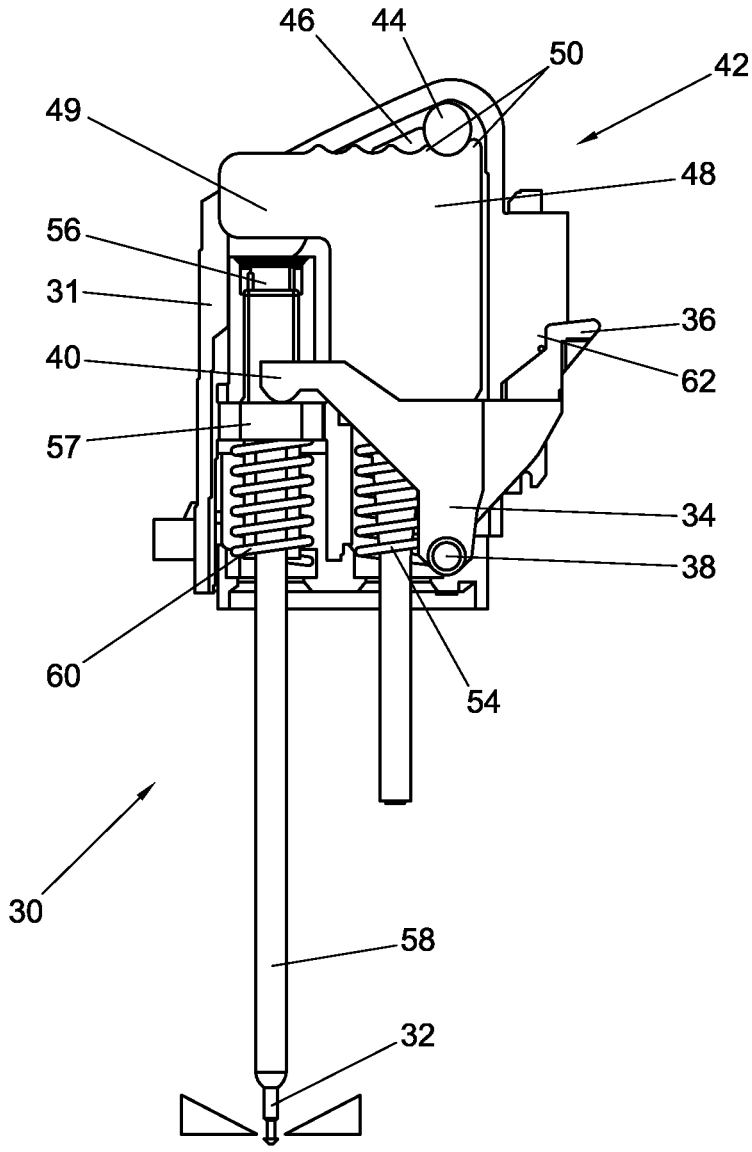
FIG. 2 is a schematic side view of a steam rate control assembly as shown in FIG. 1.

Referring primarily to FIG. 2, the exemplary steam rate control assembly 30 comprises a support structure 31 to which a steam shaft 58, a switch 42 and a lever 34 are moveably connected. A lower end of the steam shaft 58 coincides with the aforementioned valve 32. Said lower end normally extends through a valve opening 33 (see FIG. 1) and tapers off to a point. When the steam shaft 58 is in its lowest position, its lower end may block the valve opening 33 completely. However, when the steam shaft 58 is raised, the valve opening 33 is gradually freed as the tapered end 32 retreats therefrom. This allows for an increasing flow of water from the water reservoir 12 to the steam chamber 18. The higher end of the steam shaft 58 is formed by a steam shaft bracket 56, which is slideably moveable in a generally vertical direction within the support structure 31. The steam shaft bracket 56 is spring-loaded by a spring 60 that forces the steam shaft bracket 56, and hence the steam shaft 58 as a whole, upwards. The highest position that may be occupied by the steam shaft bracket 56 at any time is restricted by one of the switch 42 and the lever 34.

The switch 42 comprises a selector pin 44, a guide slit 46 and a spring-loaded switch body 48. The selector pin 44 may be operatively connected to a user-control that is accessible from the outside of the housing 2 of the steam iron 1. Said user-control may take any suitable form, and for example be a turnable knob, a dial, a slider, etc. Alternatively, when the selector pin 44 is itself suitably shaped and positioned, the selector pin 44 may be identified with a user-control. The selector pin 44 is slideably moveable within the guide slit 46 that is provided in the support structure 31. The guide slit 46 extends slantingly upwards, as can be best seen in FIG. 3. The switch body 48 is also slideably moveable within the support structure 31, in a generally vertical direction. It deserves notice that this direction has a component that is perpendicular to the direction in which the guide slit 46 extends. The switch body 48 is spring-loaded by a spring 54 and serves, inter alia, to define a number of selectable selector pin positions, each of which is associated with its own steam rate. To this end, a top surface of the switch body 48 is provided with serrations 50 between any two of which the selector pin 44 is partly receivable. The spring action of spring 54 forces the switch body 48 upwards to lock the selector pin 44 in place between a selected pair of serrations 50 and an upper edge of the guide slit 46. The selected position of the selector pin 44 determines the vertical position of the switch body 48. Depending on its vertical position, an arm 49 of the switch body 48 may contact a top end of the spring-loaded steam shaft bracket 56 to restrict the upward movement thereof. Typically, such restricting contact occurs only when the selector pin 44 occupies one of the more left selector pin positions, which correspond to a relatively low vertical position of the switch body 48. When the upward movement of the spring-loaded steam shaft bracket 56 is not restricted by the arm 49 of the switch body 48, it may be restricted by contact with the lever 34 instead.

The lever 34 comprises a lever effect end 36, a lever load end 40 and a lever fulcrum 38. The lever effect end 36 is operably connected to the intuitive handle 4, either directly or through the intermediation of an optional link mechanism. The connection is such that a downward movement of the handle 4 towards its second, lower position corresponds to a clockwise rotation of the lever 34 around the fulcrum 38. It is understood that the clockwise rotation of the lever 34 involves the lifting of the lever load end 40. When no downward force is exerted on the handle 4, the biasing mechanism 8 will force the handle 4 into its first, elevated position such that the lever 34 is rotated in a counter-clockwise direction and the lever load end 40 is lowered. The counter-clockwise rotation of the lever 34 may be halted when the handle 4 reaches its first position or when the lever effect end 36 contacts a stop 62 provided by the support structure 31. The lever load end 40 may interact with the steam shaft bracket 56 at the stop 57 provided thereon. Contact with the stop 57, however, will not halt a counter-clockwise rotation of the lever as the biasing mechanism 8 is configured to overcome the spring action of spring 60.

With regard to the terminology, it is noted that the positions of the selector pin 44 that effect a situation wherein the upward motion of the steam shaft bracket 56 is restricted by the switch body 48, and not by the lever load end 36 in its lowest position, may define the first state of the user-control. Any position of the selector pin 44 that effects a situation wherein the lever load end 36 in its lowest position restricts the upward motion of the steam shaft bracket 56, on the other hand, corresponds to a user-control in its second state.

Figure 4:
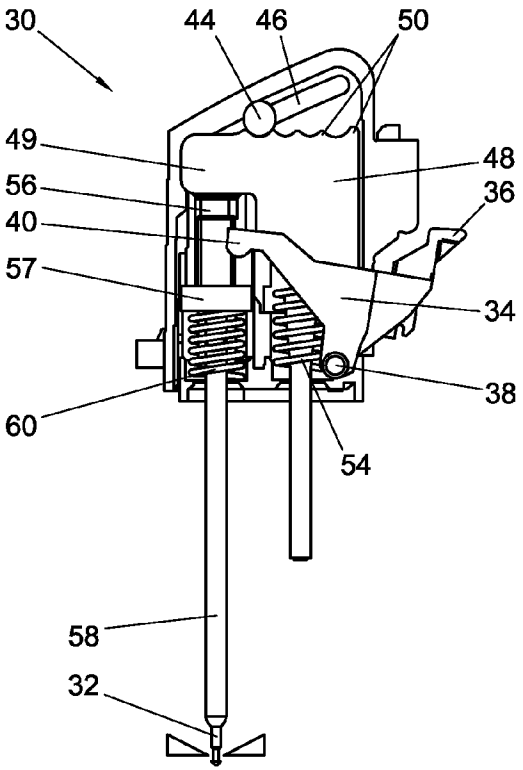
FIGS. 3 and 4 illustrate the operation of the exemplary mechanical steam rate control assembly shown in FIG. 2 when the user-control is in its first state.
Figure 3:
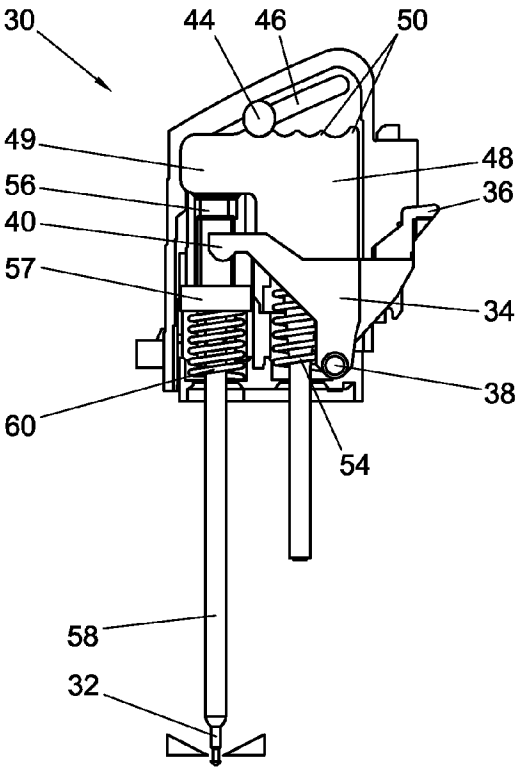
Figure 6:
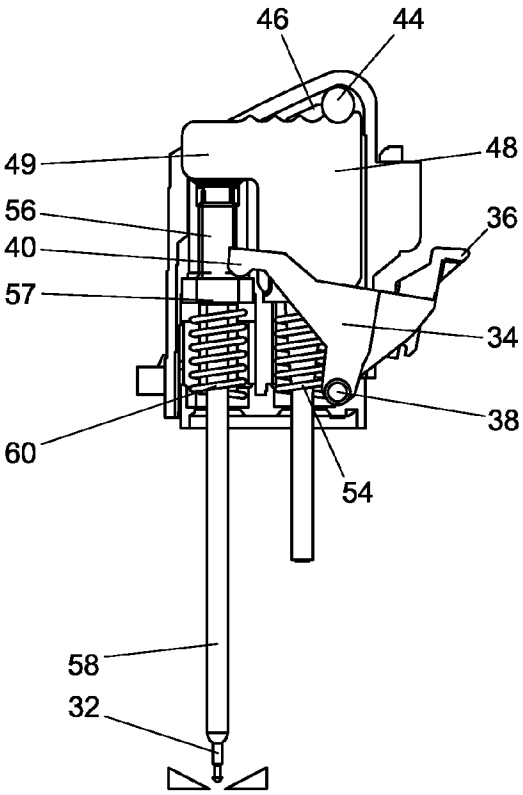
FIGS. 5 and 6 illustrate the operation of the exemplary mechanical steam rate control assembly shown in FIG. 2 when the user-control is in its second state.
Figure 5:
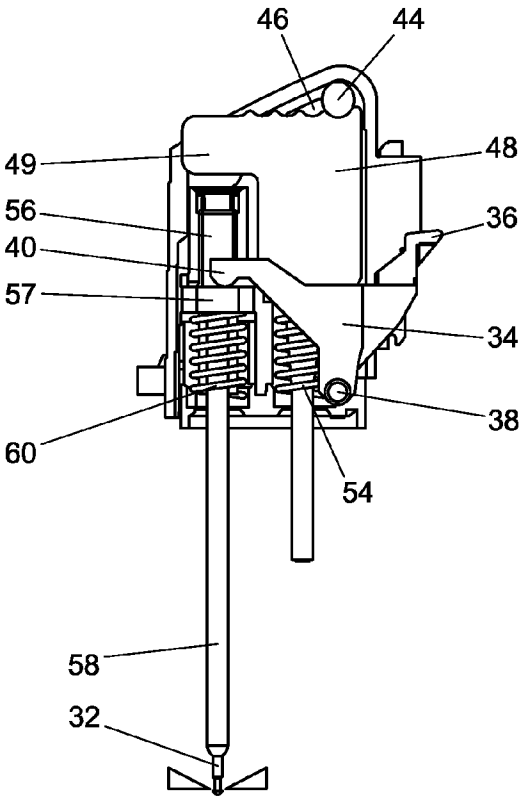

FIGS. 3-6 illustrate the operation of the steam rate control assembly 30 shown in FIG. 2. FIGS. 3 and 5 show the steam rate control assembly 30 with the lever 34 in its rest position, while FIGS. 4 and 6 show the assembly 30 with the lever 34 in a rotated position that corresponds to a pressed-down intuitive handle 4.

In FIGS. 3 and 4, the steam rate control assembly 30 is shown at a low steam rate setting. The selector pin 44 occupies a position between the two leftmost serrations 50 of the switch body 48, which position corresponds to a user-control in its first state. As can be seen, the lever load end 40 does not contact the stop 57, and the upward movement of the steam shaft bracket 56 is restricted by the contact between its upper end and the arm 49 of the switch body 48. As shown in FIG. 4, a clockwise rotation of the lever 34 merely increases the gap between the lever load end 40 and the stop 57. The rotation does not influence the position of the steam shaft 58. Accordingly, the steam rate of the iron is determined only by the position of the selector pin 44. In an embodiment of the steam iron, the handle 4 may be locked in place when the user-control is in the first state. This would prevent the handle 4 from pivoting idly, i.e. without controlling the position of the steam shaft 58, which might lead a user to think that the user-control is actually in the second state and not functioning. The locking of the handle may be effected in numerous ways, as will be apparent to one skilled in the art.

Departing from the situation shown in FIGS. 3 and 4, the steam rate of the iron may be increased by sliding the selector pin 44 in an oblique, upward right direction through the guide slit 46. The selector pin 44 will consecutively lock in place between different serrations 50 of the switch body 48, which at the same time causes the spring-loaded switch body 48 to be moved upward. The upward motion of the switch body 48, and in particular its arm 49, allows the spring-loaded steam shaft 58 to rise as well. Since elevation of the steam shaft 58 lifts the tapered end 32 thereof from the valve opening 33, an upward right movement of the selector pin 44 leads to an increased valve opening, and hence an increased steam rate of the iron 1.

At some point, the sliding selector pin 44 will effect a situation wherein the steam shaft bracket 56 touches the lever load end 40 at stop 57, and loses contact with the arm 49 at its top end. From that point on, the upward movement of the steam shaft 58 is no longer restricted by the switch body 48, but by the lever 34. Accordingly, it is the position of the intuitive handle 4, which is operably connected to the lever 34, that determines whether the steam rate is increased any further or not. This situation, which is depicted in FIGS. 5 and 6, corresponds to a user control is in its second state.

The steam rate control assembly 30 shown in FIGS. 1-3 is entirely mechanical, i.e. does not comprise any electric or electrically controlled components. Although a (partly) electric steam rate control assembly may be used in alternative embodiments, a mechanical construction is generally preferable as it is more economical in terms of manufacturing costs.

By way of example a number of embodiments of a steam rate control assembly featuring electric components will be described briefly. In one embodiment the steam rate control assembly may comprise an electric pump by means of which a water flow rate in the water channel 10 (see FIG. 1) can be controlled. An advantage of an electric pump is that it allows for configurations wherein the flow of water from the water reservoir 12 to the outlet openings 14 in the soleplate 16 of the iron is not gravity-driven. In addition, a pump may allow for much higher steam rates than can be obtained using a merely mechanical steam rate control assembly. Compared to the mechanical embodiments discussed above, the electric pump may effectively replace the valve 32. Other than that, the described steam rate control assembly 30 may be used without modifications when the flow rate of the pump can be adjusted mechanically, keeping in mind that the steam shaft 58 now adjusts the flow rate setting of the electric pump instead of the position of a valve.

Alternatively, the flow rate setting of the electric pump may be controlled electronically, for example by means of a certain electric signal having a variable voltage or frequency. In that case, the steam rate control assembly may comprise an electronic control unit, e.g. a processor. In addition, the user-control may be an electric control, e.g. an electronic switch, and the handle 4 may be fitted with a displacement sensor or a force sensor to register the displacement of or the force exerted on the handle. In an advantageous embodiment, the electronic control unit may be programmable by the user, such that the user may for example set the steam rates associated with different positions of the user-control precisely as desired. —It is noted that the electric pump, like the water reservoir 12, need not to be integrated into the housing 2 of the iron, but may be disposed external thereto instead.

Although illustrative embodiments of the present invention have been described with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that the particular features, structures, or characteristics may be combined in any suitable manner in one or more embodiments.

The invention claimed is:

1. A steam iron comprising:

a handle, moveable between a first handle position and a second handle position, whereby a biasing mechanism is provided to bias the handle into the first handle position;

a user-control adjustable between a first state and a second state; and a steam rate control assembly, operatively connected to the handle and the user-control, the steam rate controller comprising:

an adjuster moveable between a first adjuster position and a second adjuster position and operatively connected to the handle, whose position determines the position of the adjuster;

a switch body—moveable between a first switch body position and a second switch body position and operatively connected to the user-control that determines the position of the switch body;

a spring-loaded steam shaft moveable between a first steam shaft position and a second steam shaft position, the steam shaft being biased towards the second steam shaft position, and the first steam shaft position being associated with a lower steam rate than a stream rate associated with the second steam shaft position wherein:

movement of the steam shaft—towards the second steam shaft position is restricted by the switch body—when the user-control is in its first state; and movement of the steam shaft—towards the second steam shaft position is restricted by the adjuster when the user-control is in its second state, and a steam rate of said steam iron is set based on the user-control when the user-control is in the first state; and the steam rate of the steam iron is set based on at least a position of the handle when the user-control is in the second state.

2. The steam iron according to claim 1, wherein the steam rate control assembly is configured such that the steam rate set when the user-control is in its first state is smaller than the steam rate set when the user-control is in its second state.

3. The steam iron according to claim 1, wherein at least one of the first state and the second state of the user-control comprises at least two selectable user-control positions, each of which is associated with its own steam rate.

4. The steam iron according to claim 1, wherein the steam rate control assembly comprises mechanical components.

5. The steam iron according to claim 1, wherein the adjuster is a lever, rotatable about a fulcrum, and having a lever effect end and a lever load end, the lever effect end being operably connected to the handle and the lever load end being configured for engagement with the steam shaft so as to restrict its movement towards the second steam shaft position.

6. The steam iron according to claim 1, wherein the steam shaft at least partially coincides with, or is operably connected to, a valve, whose position determines a flow rate of water from a water reservoir to at least one outlet opening in a soleplate of the steam iron.

7. The steam iron according to claim 1, wherein the steam rate control assembly comprises an electric pump whose flow rate determines the steam rate of the steam iron.

8. The steam iron according to claim 7, wherein the steam rate control assembly comprises:

an electronic control unit, configured to set a flow rate setting of the electric pump, and operatively connected to the user-control; and a force or displacement sensor by means of which the electronic control unit is operatively connected to the handle.

9. The steam iron according to claim 1, the handle is locked in place when the user-control is in the first state.

10. A steam iron comprising:

a handle moveable between a first handle position and a second handle position, whereby a biasing mechanism—is provided to bias the handle into the first handle position;

a user-control adjustable between a first state and a second state; and a steam rate control assembly operatively connected to the handle and the user-control, said rate controller:

maintaining a base rate of steam when said user control is in said first state and said handle is positioned between said first handle position and said second handle position; and providing a rate of steam higher than said base level of steam when said user controller is in said second state, and said higher rate of steam increases as said handle is positioned between said first handle position and said second handle position.

11. The steam iron according to claim 10, wherein the steam rate control assembly is configured such that the steam rate set when the user-control is in its first state is lower than the steam rate set when the user-control is in its second state.

12. The steam iron according to claim 10, wherein at least one of the first state and the second state of the user-control comprises at least two selectable user-control positions, each of which is associated with its own steam rate.

13. The steam iron according to claim 10, wherein the steam rate controller comprises:

an adjuster moveable between a first adjuster position and a second adjuster position and operatively connected to the handle, whose position determines the position of the adjuster;

a switch body—moveable between a first switch body position and a second switch body position and operatively connected to the user-control that determines the position of the switch body;

a spring-loaded steam shaft moveable between a first steam shaft position and a second steam shaft position, the steam shaft being biased towards the second steam shaft position, and the first steam shaft position being associated with a lower steam rate than a stream rate associated with the second steam shaft position wherein:

movement of the steam shaft—towards the second steam shaft position is restricted by the switch body—when the user-control is in its first state; and movement of the steam shaft—towards the second steam shaft position is restricted by the adjuster when the user-control is in its second state.

14. The steam iron according to claim 10, wherein the adjuster is a lever rotatable about a fulcrum, and having a lever effect end—and a lever load end, the lever effect end being operably connected to the handle—and the lever load end being configured for engagement with the steam shaft—so as to restrict its movement towards the second steam shaft position.

15. The steam iron according to claim 10, wherein the steam shaft—at least partially coincides with, or is operably connected to, a valve, whose position determines a flow rate of water from a water reservoir to at least one outlet opening—in a soleplate of the steam iron.

16. The steam iron according to claim 10, wherein the steam rate control assembly comprises an electric pump whose flow rate determines the steam rate of the steam iron.

17. The steam iron according to claim 7, wherein the steam rate control assembly comprises:

an electronic control unit, configured to seta flow rate setting of the electric pump, and operatively connected to the user-control; and a force or displacement sensor by means of which the electronic control unit is operatively connected to the handle.

18. The steam iron according to claim 10, the handle is locked in place when the user-control is in the first state.

* * * * *